US008505416B1

(12) United States Patent
Phelps, Jr.

(10) Patent No.: US 8,505,416 B1
(45) Date of Patent: Aug. 13, 2013

(54) VALVE WRENCH SAFETY SYSTEM

(76) Inventor: Michael A. Phelps, Jr., Portage, IN (US)

( * ) Notice: Subject to any disclaimer, the term of this patent is extended or adjusted under 35 U.S.C. 154(b) by 177 days.

(21) Appl. No.: 13/162,094

(22) Filed: Jun. 16, 2011

(51) Int. Cl.
*B25B 13/02* (2006.01)
*B25B 13/48* (2006.01)

(52) U.S. Cl.
USPC ..... 81/90.4; 81/180.1

(58) Field of Classification Search
USPC ..... 81/90.4, 180.1, 185.2, 90.9
See application file for complete search history.

(56) References Cited

U.S. PATENT DOCUMENTS 1,544,779 A 7/1925 Scott
1,764,124 A 6/1930 Smith
2,339,760 A 1/1944 Boynton
2,448,221 A 8/1948 Jones
4,380,941 A 4/1983 Peterson
D424,387 S 5/2000 Neff

OTHER PUBLICATIONS www.gearench.com; Titan Surgrip Valve Wrench; internet; as of Jun. 16, 2011.

*Primary Examiner* — David B Thomas

(57) ABSTRACT

A valve wrench safety system used to prevent a valve wrench from slipping off a valve, having a housing with an opening in the top side where a lock slide bar is sized to fit and slide in and out of a chamber through the opening using a sliding slot on a lever-control-side, wherein the housing is attached to a rod region of a valve wrench using arms attaching to and extending from the housing to a plate by sandwiching the wrench rod region between the front surface of the housing and the plate.

5 Claims, 4 Drawing Sheets

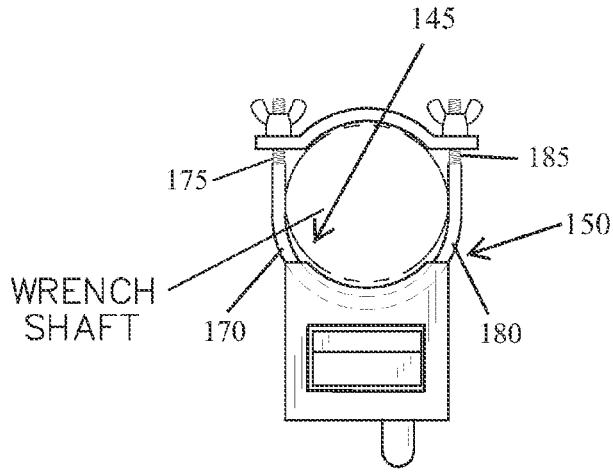
FIG. 2
TOP VIEW
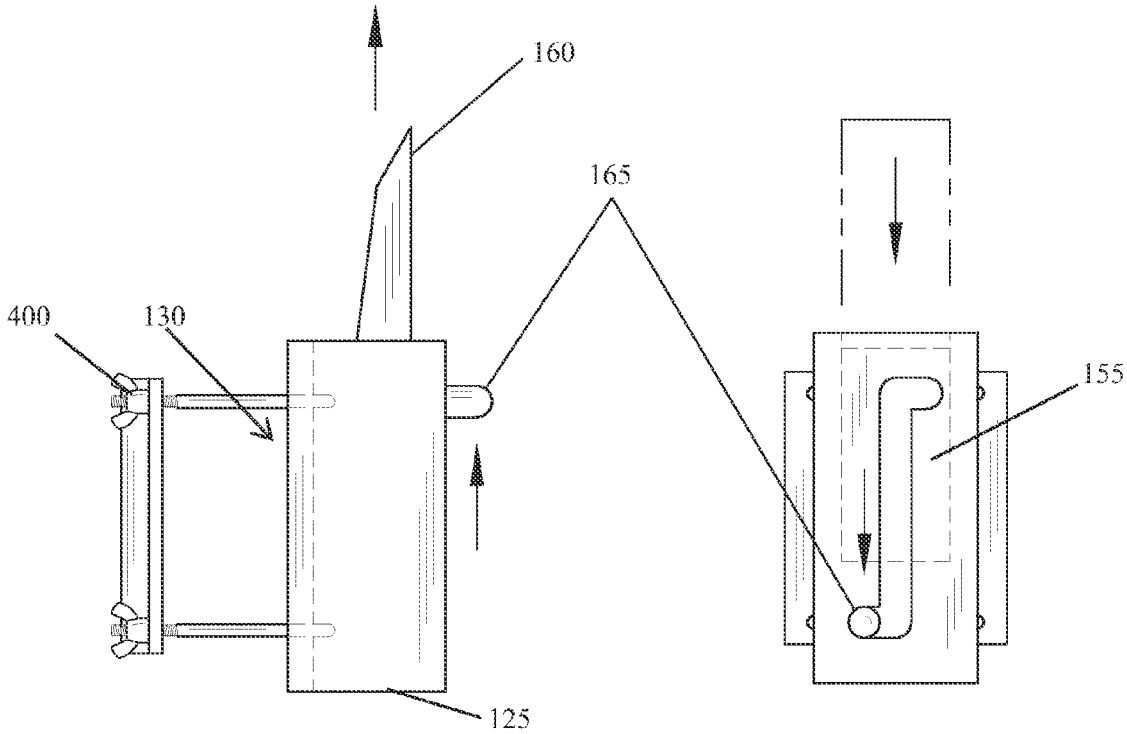
FIG. 3
SIDE VIEW
FIG. 4
FRONT VIEW

ALT. EMBODIMENT

VALVE WRENCH SAFETY SYSTEM

BACKGROUND OF THE INVENTION

The present invention is directed to a valve wrench safety system. The valve wrench safety system of the present invention provides a safer way of using a valve wrench to turn a valve.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE DRAWINGS

FIG. 2 shows a top view of a valve wrench safety system.

FIG. 3 shows a side view of a valve wrench safety system.

FIG. 4 shows a front view of a valve wrench safety system.

DESCRIPTION OF PREFERRED EMBODIMENTS

Figure 1:
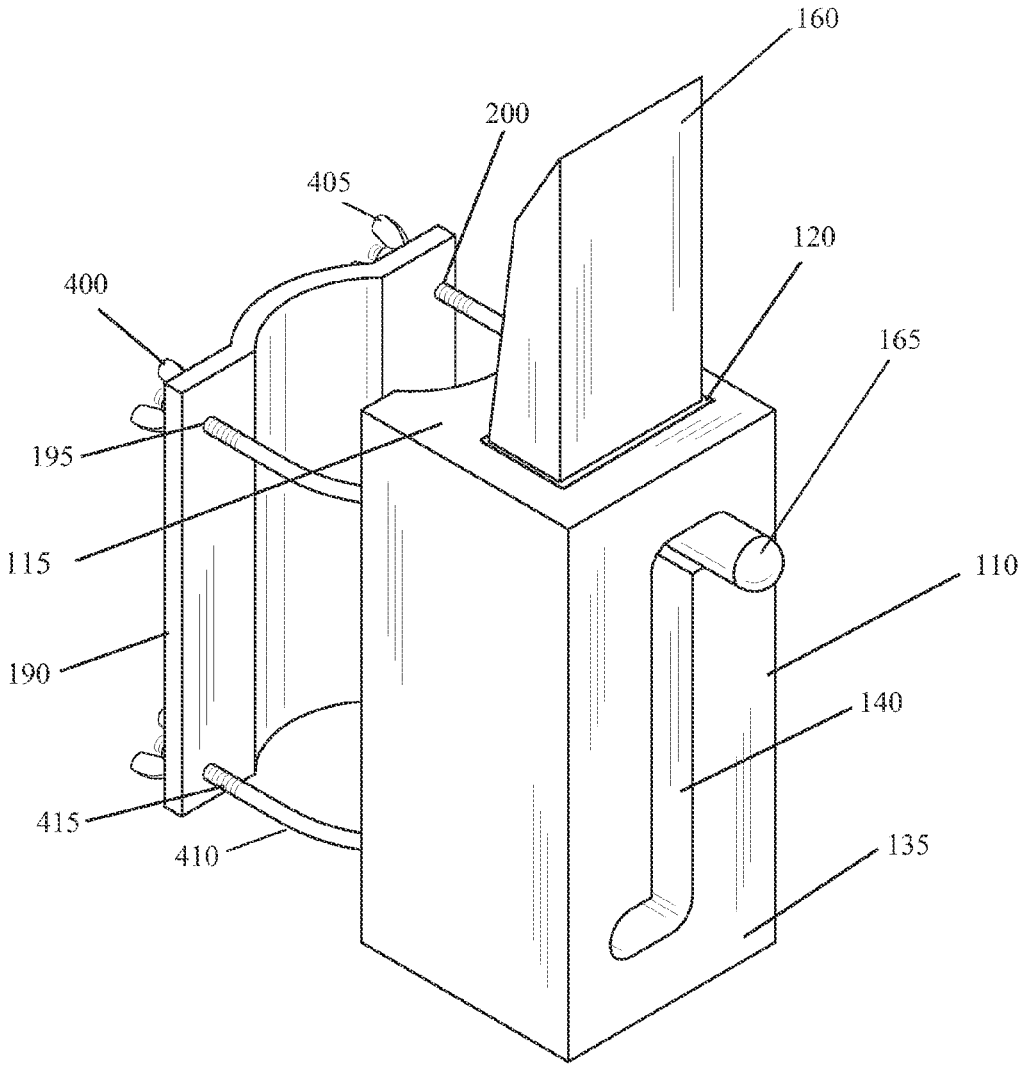
FIG. 1 shows a perspective view of a valve wrench safety system.
Figure 5:
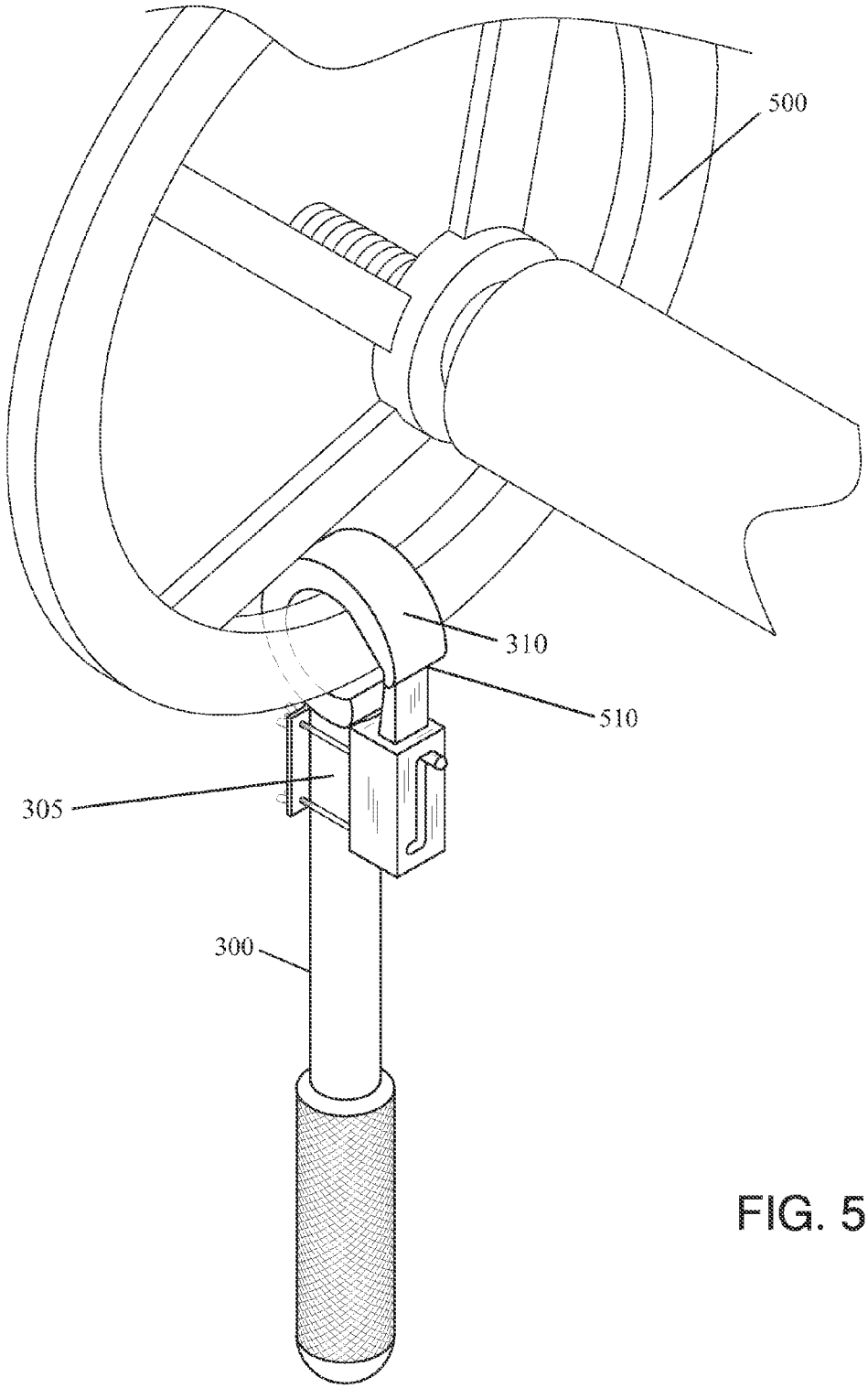
FIG. 5 shows a perspective view of a valve wrench safety system in use.
Figure 6:
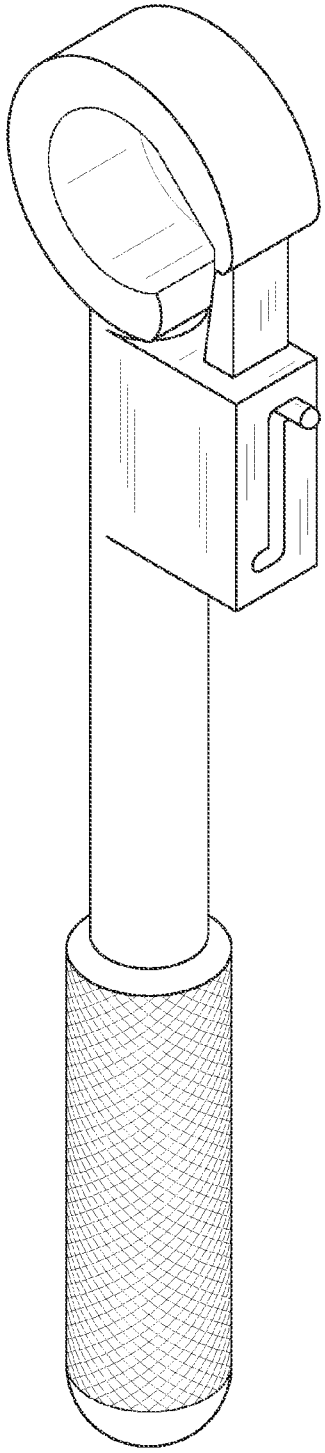
FIG. 6 shows another perspective view of an alternate valve wrench safety system.

Referring now to FIGS. 1-5, the present invention features a valve wrench safety system 100 for preventing the valve wrench from slipping off a valve 500. This system will help to eliminate or reduce the possibility of injury due to the wrench slipping off of the valve while in the process of the valve being opened.

The system comprises a housing 110 having a top side 115 with an opening 120, a bottom side 125, a front side 130, and a lever-control-side 135 having a sliding slot 140, wherein the sliding slot runs from the top side to the bottom side. The lever-control side can be on any side that is connecting the top side and the bottom side. The front side has a first front side edge 145 and a second front side edge 150. In some embodiments, there are three sides connecting to the top side and bottom side. In some embodiments, there are four sides connecting to the top side and bottom side.

The system further comprises a chamber 155 disposed within the housing. The chamber opens up to the opening on the top side of the housing. The system further comprises a lock slide bar 160 which is sized to fit through the opening and sized to slide in and out of the chamber. The system further comprises a slide lever 165 which is attached to and extends outwardly away from the lock slide bar. The slide lever protrudes through the housing through the sliding slot. When the sliding lever is pushed upward towards the top side, it causes the lock slide bar to extend upward from the top side. When the sliding lever is pushed downward towards the bottom side, it causes the lock slide bar to retract into the chamber. This system will eliminate a heavy wrench from falling off a valve because it will be locked onto the valve securely. After the valve is opened, the lock slide bar can be quickly disengaged in order to continue using the wrench to completely open the valve.

The system further comprises a first arm 170 attaching to and extending from the first front side edge away from the housing. The first arm has a first distal end 175 with screw threading. The system further comprises a second arm 180 attaching to and extending from the second front side edge away from the housing. The second arm has a second distal end 185 with screw threading. The first and second arms extend outwardly in the same direction.

The system further comprises a plate 190 having a first hole 195 to accommodate a penetration of the first distal end of the first arm, and a second hole 200 to accommodate a penetration of the second distal end of the second arm.

The system is secured to a valve wrench 300 at a wrench rod region 305 adjacent to a curve head portion 310 of the valve wrench by sandwiching the wrench rod region between the front surface of the housing and the plate. The first arm and second arm wrap around the wrench rod region. A first wing nut 400 is screwed onto the threading of the first arm, and a second wing nut 405 is screwed onto the threading of the second arm. This pushes the plate against the wrench rod region to prevent the valve wrench from slipping off, then the lock slide bar is pushed to extend upward from the top side.

In some embodiments, the housing of the system has a shape of a block.

In some embodiments, the system further comprises a third arm 410 attaching to and extending from the first front side edge away from the housing. The third arm has a third distal end 415 with screw threading. In some embodiments, the system further comprises a fourth arm attaching to and extending from the second front side edge away from the housing. The fourth arm has a second distal end with screw threading, wherein the first and second arm extends outwardly in the same direction.

In some embodiments, the front surface of the system is caved towards the housing as to accommodate the wrench rod region.

In some embodiments, the system is stripped of the first and second arms and the plate, and the housing is permanently secured to the wrench rod region, wherein when the slide lever bar is extended, it is extended towards the distal end of the head portion of the valve wrench 510.

In some embodiments, the system is made of steel, aluminium or the like.

The disclosures of the following U.S. Patents are incorporated in their entirety by reference herein: U.S. Pat. No. 1,764,124; U.S. Pat. No. 2,448,221; U.S. Pat. No. 4,380,941; U.S. Pat. No. 1,544,779; U.S. Pat. No. 2,339,760; and U.S. Design Pat. No. D424387.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A valve wrench safety system (100) for preventing the valve wrench from slipping off a valve (500), the system comprising:

(a) a housing (110) having a top side (115) with an opening (120), a bottom side (125), a front side (130) and a lever-control-side (135) having a sliding slot (140) wherein the sliding slot runs from the top side to the bottom side, the front side having a first front side edge (145) and a second front side edge (150);

(b) a chamber (155) disposed within the housing, the chamber opens up to the opening on the top side of the housing;

(c) a lock slide bar (160) sized to fit through the opening and sized to slide in and out of the chamber;

(d) a slide lever (165) attached to and extending outwardly away from the lock slide bar, the slide lever protrudes through the housing via the sliding slot; wherein pushing the sliding lever upward towards the top side causes the lock slide bar to extend upward from the top side and wherein pushing the sliding lever downward towards the bottom side causes the lock slide bar to retract into the chamber;

(e) a first arm (170) attaching to and extending from the first front side edge away from the housing, the first arm has a first distal end (175) with screw threading; a second arm (180) attaching to and extending from the second front side edge away from the housing, the second arm has a second distal end 185 with screw threading, wherein the first and second arm extends outwardly in the same direction;

(f) a plate (190) having a first hole (195) to accommodate a penetration of the first distal end of the first arm, and a second hole (200) to accommodate a penetration of the second distal end of the second arm, wherein the system is secured to a valve wrench (300) at a wrench rod region (305) adjacent to a curve head portion (310) of the valve wrench, by sandwiching the wrench rod region between the front surface of the housing and the plate wherein the first arm and second arm wrap around the wrench rod region; wherein a first wing nut (400) is screwed onto the threading of the first arm and a second wing nut (405) is screwed onto the threading of the second arm thereby pushing the plate against the wrench rod region;

wherein to prevent the valve wrench from slipping off, the lock slide bar is pushed to extendly upward from the top side.

2. The system of claim 1 wherein the housing has a shape of a block.

3. The system of claim 1 further comprising a third arm (410) attaching to and extending from the first front side edge away from the housing, the third arm has a third distal end (415) with screw threading; a fourth arm attaching to and extending from the second front side edge away from the housing, the fourth arm has a second distal end with screw threading, wherein the first and second arm extends outwardly in the same direction.

4. The system of claim 1 wherein the front surface is caved towards the housing as to accommodate the wrench rod region.

5. The system of claim 1 being stripped of the first and second arm and the plate, wherein the housing is permanently secured to the wrench rod region, wherein when the slide lever bar is extended it is extended towards the distal end of the head portion of the valve wrench (510).

* * * * *